US005386911A

United States Patent [19]

Payne

[11] Patent Number: 5,386,911

[45] Date of Patent: Feb. 7, 1995

[54] VARIABLE DEPTH MEMBRANE PACKING

[76] Inventor: Thomas M. Payne, 12 Bennington Dr., Tappan, N.Y. 10983

[21] Appl. No.: 72,728

[22] Filed: Jun. 7, 1993

[51] Int. Cl.[6] ..... B65D 81/02; B65D 85/30

[52] U.S. Cl. ..... 206/583; 206/586; 206/591; 220/530; 220/531; 220/529

[58] Field of Search ..... 206/591, 593, 594, 583; 220/530, 531, 529

[56] References Cited

U.S. PATENT DOCUMENTS

| | | | |
|---|---|---|---|
| 2,501,570 | 3/1950 | Larsen | 206/583 |
| 2,837,208 | 6/1958 | Lingenfelter | 206/583 |
| 3,692,264 | 9/1972 | Burkhard et al. | 206/583 |
| 3,853,220 | 12/1974 | Luray | 206/583 |
| 4,173,286 | 11/1979 | Stanko | 206/589 |
| 4,491,225 | 1/1985 | Baillod | 206/583 |
| 4,522,303 | 6/1985 | Starr | 206/588 |
| 4,606,460 | 8/1986 | Luray | 206/583 |
| 4,852,743 | 8/1989 | Ridgeway | 206/583 |
| 4,923,065 | 5/1990 | Ridgeway | 206/583 |
| 5,071,009 | 12/1991 | Ridgeway | 206/586 |
| 5,218,510 | 6/1993 | Bradford | 206/583 |

FOREIGN PATENT DOCUMENTS

| | | | |
|---|---|---|---|
| 2073269 | 10/1971 | France | 206/583 |
| 3340155 | 4/1984 | Germany | 206/591 |
| 135796 | 11/1978 | Japan | 206/583 |

*Primary Examiner*—William I. Price

[57] ABSTRACT

Two or more pairs of packing spacers support objects within a shipping container in a floating arrangement that absorbs shock and vibration and protects the object from impact damage. Each packing spacer is comprised of rigid frames enclosed in stretchable membranes (22) which are held in position by collars (20) having off-center slots which form the frame assembly (18). These assemblies may be reversed or inverted in relation to each other thereby providing multiple spacing options to accommodate a variety of object shapes and sizes within a single size container.

7 Claims, 6 Drawing Sheets

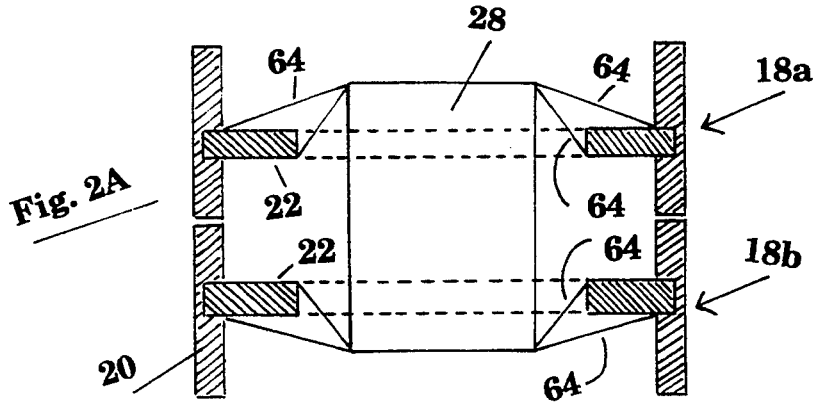
Fig. 2A
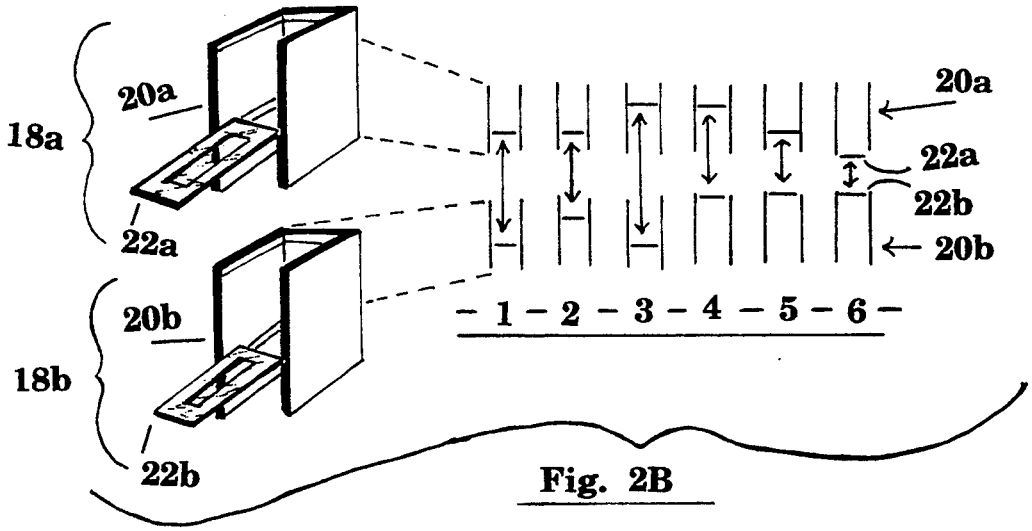
Fig. 2B
Fig. 2C
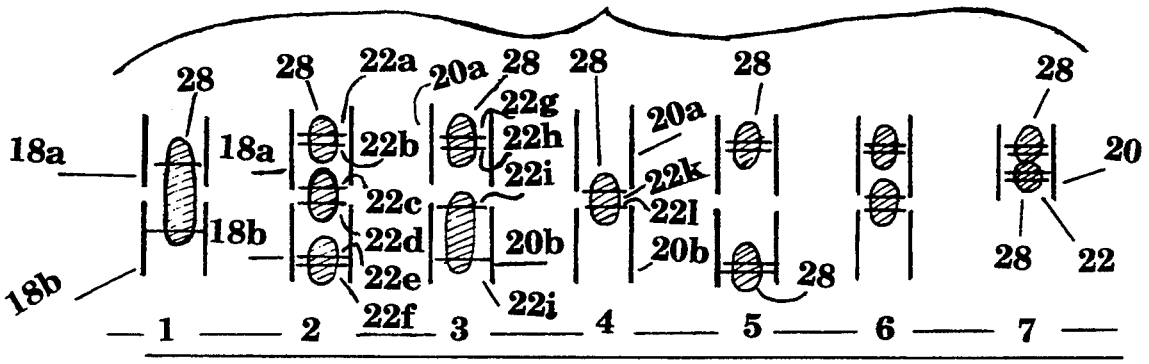

22
20d
30
30
20d 20d
44a
44b
44a
44b
20d 46a
20d
30
46a
20d 20d
44a
44a
20d 20d
30
32

Fig. 4
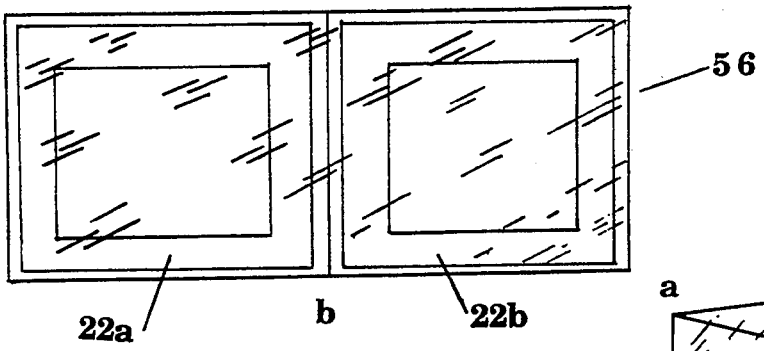
Fig. 4A
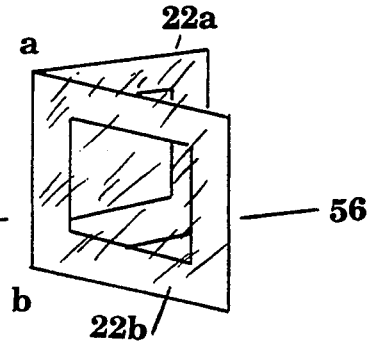
Fig. 4C
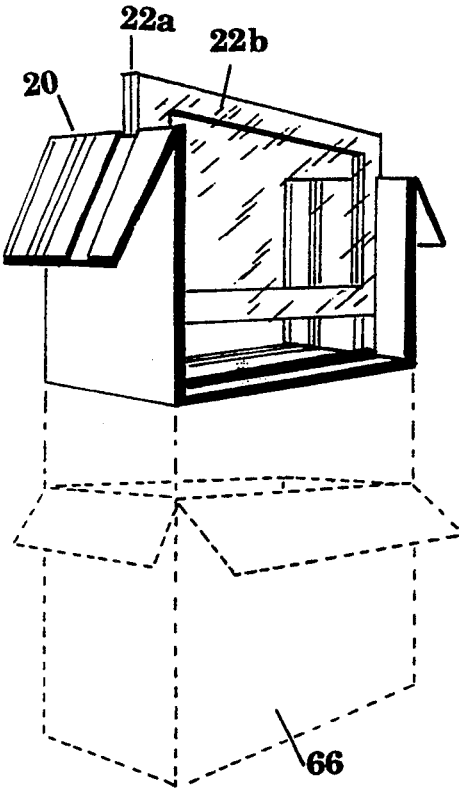
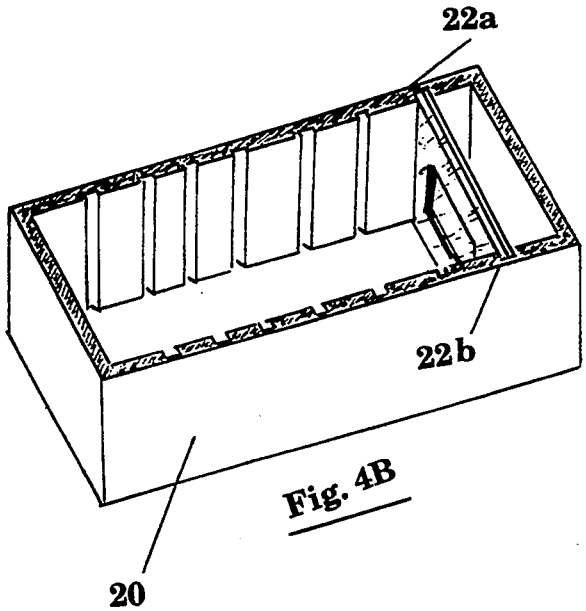
Fig. 4B

VARIABLE DEPTH MEMBRANE PACKING

FIELD OF INVENTION

This invention relates to a system of adjustable, recyclable and reusable components which would be used to package and protect valuable, fragile, or delicate items.

DESCRIPTION OF PRIOR ART

Interior protective packaging is so diverse as to almost defy description. It is often referred to as cushioning, blocking, dunnage or void filler, but perhaps it should be defined as any material inside a container other than the product. The functional and desirable qualities of these materials are more easily described as follows:

The packaging material should: be light weight; be easy to use; be versatile with many sizes, shapes, and weights of product; be able to control movement of the item within the container; minimize shock transmission to the item; absorb energy and vibration; be reusable and recyclable; be non-abrasive and protect the item's surface.

Other qualities which might be desirable would include being non or low dusting, being low or non static, and adding strength to the outer shipping container. The packaging should also be easy for the consumer to dispose of without adding unduly to the environment or landfill problems faced by many communities.

Users want the most cost-effective and efficient way of protecting their product. If it is damaged or costs twice as much to ship or mail, the bottom line cost to the customer will be more, even if an inexpensive packaging is used.

Just-in-time delivery also effects packaging needs as packages are being handled more ruggedly by same day delivery and mail services. This requires more multiple-impact protection from highly resilient packaging that returns to its original shape and provides that protection over a long period of time.

The value of any packaging material or system must be determined by the ability to perform these functions. The packaging must also be economical to the needs of the item being packaged and gauged by the needs of the user.

Many of today's packaging products are very effective and some are economical, however they all have drawbacks. The common items such as foam "peanuts" or flowables and bubble wrap take up much valuable warehouse space and are generally used once, then sent to overburdened landfills. Custom fabricated foam and corrugated packages have the same problems with the added cost associated with die-cuts, molds and set up charges. These custom packages generally are useful for a single item.

The concept of suspending fragile items for protection is well known and has been practiced in many ways and for many years.

Baillod, in U.S. Pat. No. 4,491,225 proposed a device using membranes to suspend an article within a limited container and adapted to function as a fluid damped device.

Luray in U.S. Pat. No. 3,853,220 proposed a hammock package restricted by its attachment to its container. Luray again proposed in U.S. Pat. No. 4,606,460 to use a mold or formed member to suspend an item.

Larsen proposed another method in U.S. Pat. No. 2,501,570 using formed materials which would, again, limit its use to like items. Stanko in U.S. Pat. No. 4,173,286 again uses formed members to suspend specific items.

Starr uses resilient foam to protect a package in U.S. Pat. No. 4,522,303.

Ridgeway in U.S. Pat. Nos. 4,923,065, 5,071,009, and 4,852,743 proposes a better system requiring neither air, gas, or foam but instead relies on a membrane "attached" to a frame member which is pre-sized to fit within a container designed to hold a particular sized object. By attaching a single layer of membrane over a central opening, Ridgeway provides only one layer of support to the item being protected and makes it difficult to recycle as the attaching means contaminates the plastic on removal from the supporting frame. These frames can not easily be adjusted for height more than once, limiting their reuse for items of a size other than that for which they were made.

All the above examples contain one or more elements which inhibit the use or reuse of a package for other than that for which it was designed.

OBJECTS AND ADVANTAGES

The principle object of this invention is to provide a package which will economically protect a wide variety of item sizes, shapes, and weights within a single package without requiring post-packing treatment, special equipment or training to use.

This and other objectives are met by providing the user with a reusable and easily recycled system of novel frame assemblies.

These are comprised of a rigid frame enclosed in a strong but flexible plastic or other stretchable membrane, which when surrounded, separated or supported by a rigid collar, hold the item being packaged in suspension between two frame assemblies placed in opposition within a shipping container.

This novel system provides the required suspension qualities, without the use of other elements, and uses only common tape, where desired, to assemble.

The preferred embodiment of this new method of constructing my frame assemblies permits the enclosed frames or "windows" to be placed in other than a centered primary frame slot which has been provided or cut into the supporting collars. This allows the complete frame assembly to be inverted or reversed in relation to its companion frame assembly thereby providing alternative spacing the membrane within a single outer container. By providing the option of various spacing between membrane windows, the system allows for the packaging of multiple sized items within the same container and the ability to reuse the same package for other sized items.

By enclosing the frames rather than attaching the film to the frame member, the two component materials, paper and plastic in the preferred embodiment, can be easily separated for recycling while the film covering both sides of the rigid frame provides additional security and support.

While providing a superior range of protection, this novel system address many of the problems associated with prior art. By being available "off-the-shelf", it can reduce the users inventory. Being supplied to the user in flat or knocked down condition, it requires less warehouse space. Being reusable for objects of other shapes and sizes and, being easily recycled by separating the paper and plastic components, it reduces material being sent to landfills.

DRAWING FIGURES

FIG. 1A frame assembly

FIG. 1B shows typical shipping container 24 ready to receive 1st reference assembly 18*a*, object being protected 28, and 2nd frame assembly 18*b*

FIG. 1C two frames 22 between a split collar 50*a* and 50*b*

FIG. 1D two frame assemblies separated for use in a tall container

FIG. 1E support collar 20*c* between two frame assemblies

FIG. 2A end view of two frame assemblies supporting an object

FIG. 2B shows various separations of frames 22*a* and 22*b* when two frame assemblies 18*a* and 18*b* are stacked in opposition to one another.

1) shows frame assembly 18*a* with short side down, 18*b* short side down
2) shows frame assembly 18*a* with short side down, opposing 18*b* with short side up
3) shows frame assembly 18*a* short side up, 18*b* short side down
4) shows frame assembly 18*a* short side up, and frame 22*b* resting on collar 20*b*
5) shows frame assembly 18*a* short side down, frame 22*b* resting on collar 20*b*
6) shows collar 20*a* stacked upon frames 22*a* & 22*b* and collar 20*b*

FIG. 2C shows objects 28 packaged between various frames 22*a* and 22*b* positioned within collars 20*a* and 20*b;*

1) single object 28 between two frame assemblies 18*a* and 18*b*
2) three objects 28, 1st between two frames 22*a* and 22*b;*

2nd between two frames 22*c* and 22*d* nested between frames assemblies 18*a* and 18*b* 3rd between two frames 22*e* and 22*f*

3) two objects 28, 1st between two frames 22*g* and 22*h* in collar 20*a*, 2nd between one frame 22; and frames 22*i* between collars 20*a* & 20*b*
4) single object 28 in two frames 22*k* and 22*l* held between collars 20*a* and 20*b*
5) two objects 28 between four frames in two collars
6) two objects between two frames in one collar and two frames between opposing collars
7) two objects 28 between four frames held in a single collar 20

FIG. 3 shows collar section 20*d* with material removed to provide prime slot 30 sized to receive a single frame 22

FIG. 3A collar section 20*d* slotted for two pair of frames

FIG. 3B collar section 20*d* slotted for two single frames

FIG. 3C collar section 20*d* slotted for one pair of frames

FIG. 3D enlarged cross sectional view of collar section

FIG. 4 shows two frames 22*a* and 22*b* sealed in common membrane 56 with the seal points a–b forming a hinge FIG. 4A air of frames 22*a* and 22*b* in common membrane 5 folded at hinge points a and b FIG. 4B shows collar 20 with slots or means to hold multiple pairs of frames 22*a* and 22*b*

FIG. 4C shows one pair of frames 22*a* and 22*b* within a single collar for placement in a container shown in phantom for clarity FIG. 5A shows an alternative collar construction 52 of die cut substantial material such as corrugated paper FIG. 5B sectional end view of alternate double wall construction of collar showing corrugation in short direction FIG. 5 sectional end view of alternate double wall construction of collar showing corrugation in long direction FIG. 6A semi-circular channel in membrane sleeve with point "a" being a potential hinge FIG. 6B angular channel in membrane sleeve with point "a" being a potential hinge FIG. 6C angular "U" shaped channel in membrane sleeve FIG. 7A object being protected in sleeved forms.

REFERENCE NUMERALS IN DRAWINGS

Suffixed numerals indicate the same item as used in multiples within the same figure.

Point "a" in FIGS. 6A, 6B, and 6C along with points a-b in FIGS. 4 and 4A indicate potential hinge points if two covering membranes are joined at those points.

2C 1 to 6 spacing variations
2D 1 to 7 use examples
18 frame assembly
18*a* frame assembly
18*b* frame assembly
20 collar
20*a* collar
20*b* collar
20*c* supporting collar
20*d* collar segment or section
21 protruding frame corners
22 enclosed frame
23 aperture
24 shipping container sized to frame assemblies alone
28 object being protected
30 primary or prime frame slot
32 additional frame slits
44*a* double width frame slot
44*b* double width frame slot
46*a* single frame slot
46*b* single frame slot
50*a* split collar as supports
50*b* split collar as supports
52 alternate wrap-around collar
56 common membrane enclosing two frames
64 membrane layer
66 shipping container with short side opening
68 collar bending score points
70 semi-circular rigid channel forms
72 membrane sleeves
74 angular forms
76 angular "U" shaped channel forms
78 membrane covered forms

DESCRIPTION OF THE PREFERRED EMBODIMENT INCLUDING RAMIFICATIONS

Figure 1A:
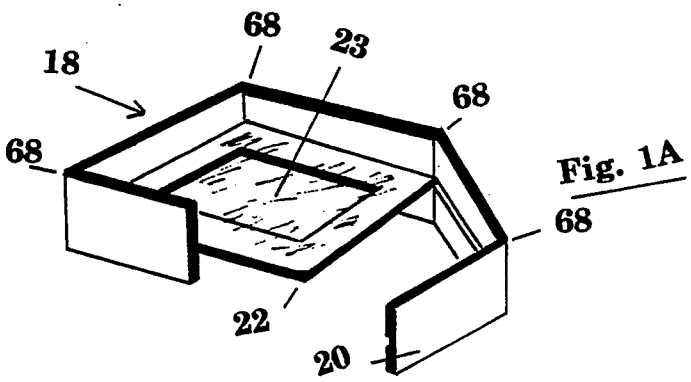
Figure 1B:
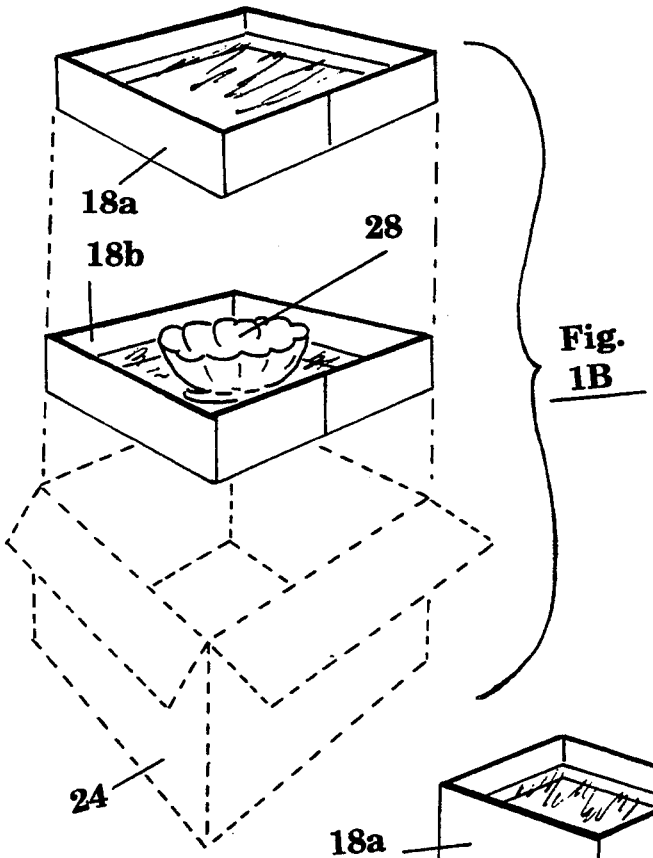

In the preferred embodiment shown in FIG. 1B, an item 28 being protected is placed between two frame assemblies 18*a* and 18*b* then into outer shipping container 24. The shipping container 24 having been presized to accommodate two assemblies without regard for item 28 and fitting snug. FIG. 1A shows the preferred embodiment of my frame assembly 18 comprised of three components.

The rigid frame 22 in the preferred embodiment is formed of a sheet of pasted chipboard. This sheet of material is cut to form a central aperture 23 of desired size and shape. The thickness of the material used and the remaining frame width between the aperture and the outside frame dimension must be sufficient to provide the required support to the flexible membrane covering 64 as shown in FIG. 2A. The covering membrane must be of sufficient thickness, strength and flexibility to provide the desired product protection when substantially sealed around the rigid frame by means appropriate to the material being used.

The materials used to create both the rigid frame and the enclosing membrane are variable and may be determined by testing to meet a specific requirement. Although the materials used in the preferred embodiment are 0.200 pasted chipboard and 6 mil clear vinyl, other material might achieve similar or desired results. For example, by using a thicker chipboard, a larger aperture might be created in a frame of like outside dimensions which would allow larger items to be packaged within the same container without sacrificing strength. Likewise, the thicker material using the same size aperture and narrower frame width might allow the overall size of container 24 to be reduced by reducing the outside frame dimensions. Color might be added to the frames, membranes, and or collars. Anti-static material might be used as well as custom printed materials.

The aperture allows the item to protrude through the flat plane of the rigid frame as in FIG. 2A to the limitation of the membrane 64 and determined by the selected orientations of the frame assemblies within the outer container.

Figures 3, 3A, 3B, 3C, 3D:
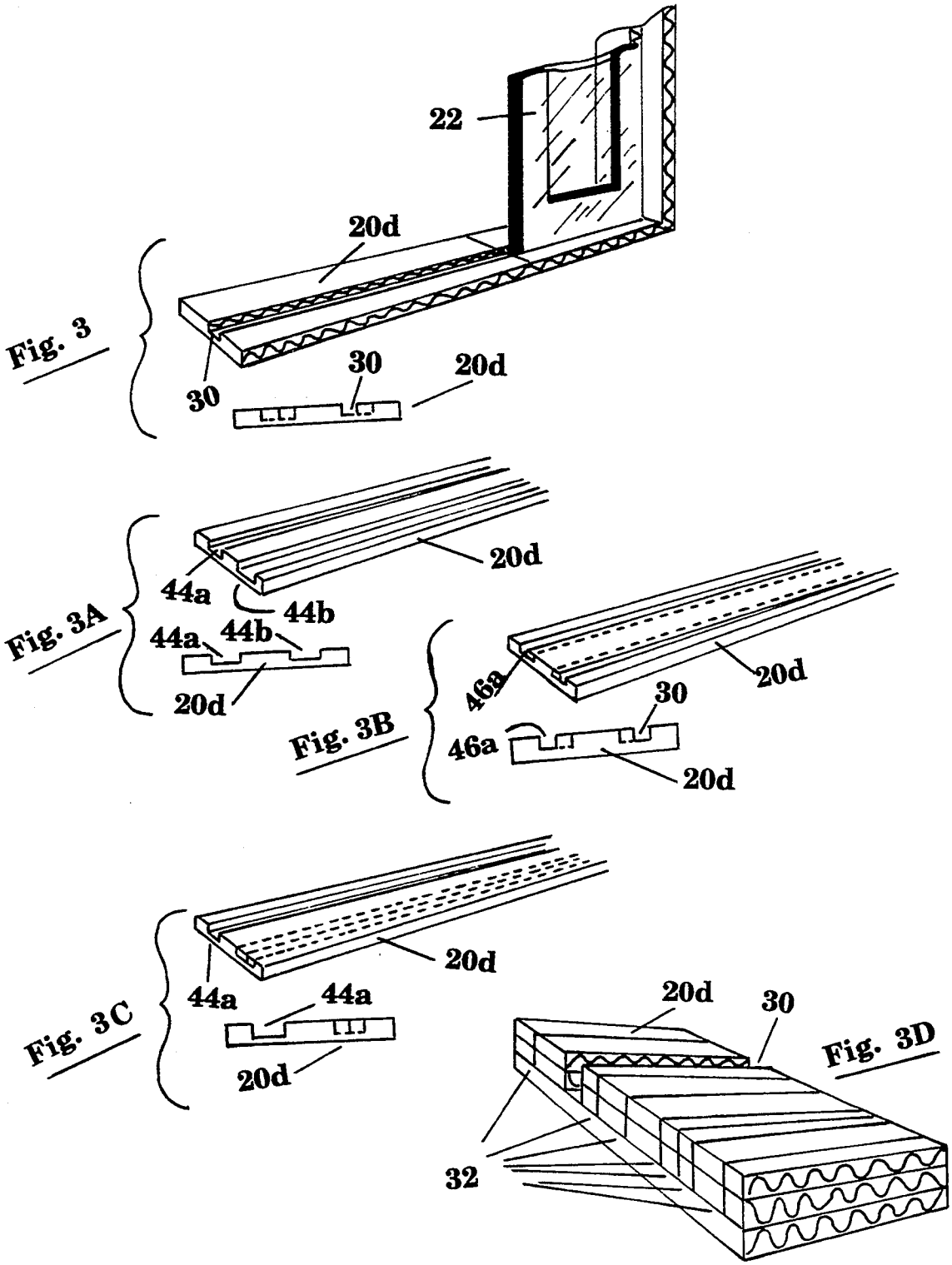

Collar 20 being made from triple wall corrugated paper is provided with a primary or prime frame slot, mortise or groove. These prime slots are created by cutting two slits in the long direction to an appropriate depth and width, then removing the stock or material between these slits to sufficient depth so as to hold enclosed frame 22 securely when the collar is bent around the frame at scores 68 and placed within whipping container 24. The collars may be provided with additional slits to allow for removal of other material. This would allow new slots to be created or existing slots to be widened to accept multiple frames. This is shown on collar segments **20*d* in FIGS. 3 through 3D. FIG. 3D being an enlarged cross sectional view of the preferred embodiment of collar 20 shows the triple wall corrugated construction. Also shown are prime slot 30 and additional slits 32** in arbitrary or selected positions.

FIGS. 3, 3A, 3B, 3C and 3D show sections **20*d* of collar 20 with slots created to accept various frame combinations. FIG. 3A shows slots for two pairs of frames in one collar using slots 44*a* and 44*b*. FIG. 3B shows slots for two single frames 22 in slots 46*a* and prime slot 30. FIG. 3C shows slot 44*a* sized to accept one pair of frames. FIG. 3 shows prime slot 30 for a single frame 22**.

Figure 5A:
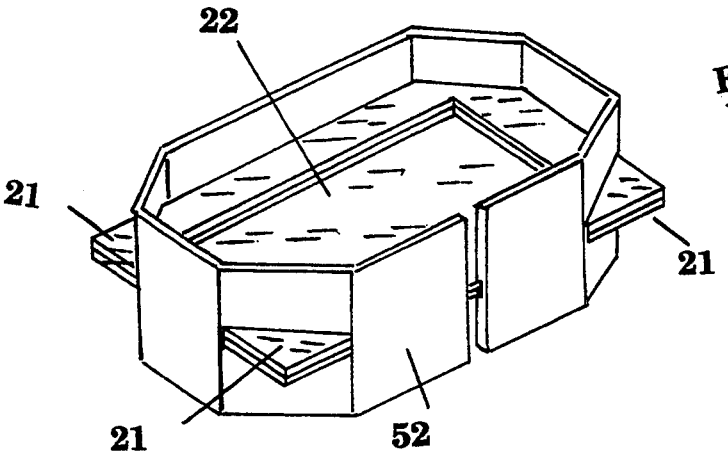
Figure 5B:
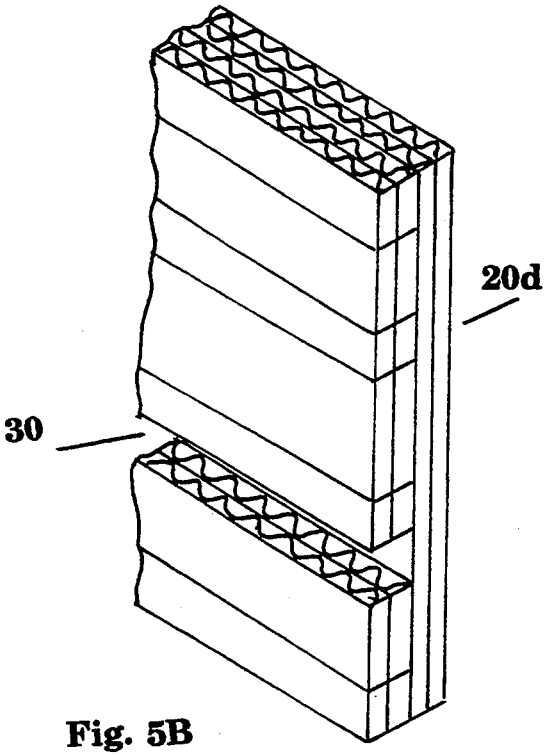
Figure 5C:
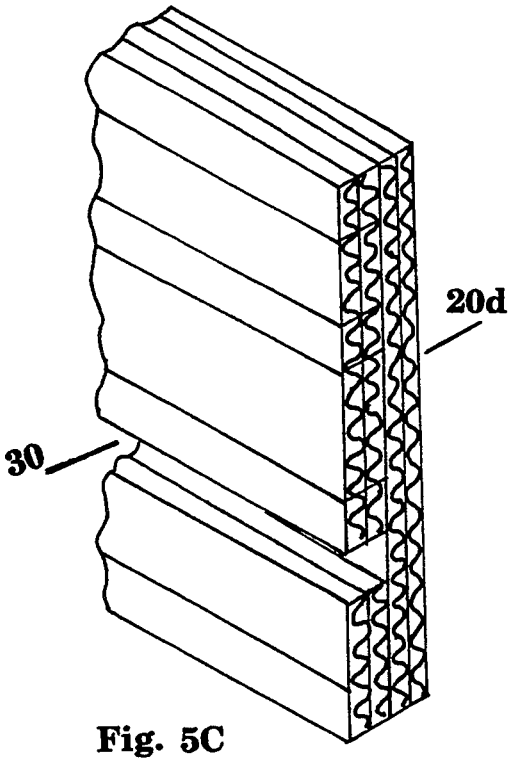

The preferred embodiment of collar 20 describes the use of triple wall corrugated as shown in FIG. 3D. Other embodiment might include but are not limited to, die cut material 52 in FIG. 5A used to surround a single or pair of frames 22 with support being provided by the protruding corners 21 of frames 22. Another collar construction is shown in FIGS. 5B and 5C. Here the use of double wall corrugated having been back slit, folded and glued to form the prime slot 30, with or without additional slits and the corrugation running in either direction is shown.

The user has the option of placing two opposing assemblies in upright or inverted relationship to each other thereby creating a variety of spacings between supporting "windows" or membranes as in FIG. 2B, examples 1 through 6. The user of this novel system of components might choose one of these options to exert sufficient pressure and friction to suspend or float their item within a container while providing standoff from the rigid frame and container walls. If the prime slots do not provide the desired spacing, other slots can be created by removing material between other slits as described above.

Figure 1C:
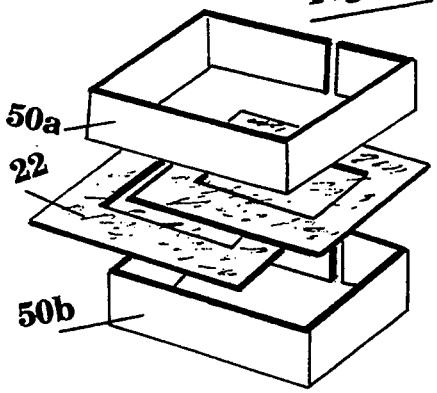

As seen in FIG. 1C, the frames need not be placed in a slot in order to function but may be placed on top of or between collars or collar sections **50*a* and 50*b* to achieve other spacings as desired. This is also shown in FIG. 2B, spacing examples 4, 5, and 6**.

In this configuration, the system provides substantial protection from shock, vibration and impact.

FIG. 2C shows how a variety of objects may be contained between a number of frames within one or two collars as in the following examples: corresponding slot numbers are shown in FIGS. 3 through 3C.

1) single object 28 between two frame assemblies **18*a* and 18*b***
2) three objects 28, 1st between two frames **22*a* and 22*b* in one slot; 2nd between two frames 22*c* and 22*d* nested between frame assemblies 18*a* and 18*b*; 3rd between two frames 22*e* and 22*f* in slot 44*a***
3) two objects 28, 1st between two frames **22*g* and 22*h* in slot 44*a* or 44*b* in collar 20*a*, 2nd between one frame 22*j* in slot 46*a* or prime slot 30 and one frame 22*i* between collars 20*a* and 20*b***
4) single object 28 in two frames **22*k* and 22*l* held between collars 20*a* and 20*b***
5) two objects 28 between four frames in two collars using slots **44*a*** or 44*b*
6) two objects between two frames in one collar and two frames between opposing collars
7) two objects 28 between four frames 22 in slots **44*a* and 44*b* held in a single collar 20**

This is achieved by using additional standard components of the system and creating other slots as explained above.

The use of the term "standard" relates to sizes as determined by the manufacturer and deemed appropriate in the marketplace.

The various combinations of frames, collars and containers allow the user to begin with a basic combination or system which can be supplemented with additional components as needs dictate without creating custom packaging for each new requirement. Cost savings should be realized through reduced inventory, lower cost for small quantities of special design packaging, reusability, and "off-the-shelf" availability allowing for smaller purchases.

Figure 1D:
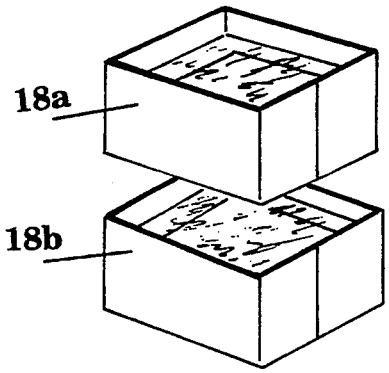
Figure 1E:
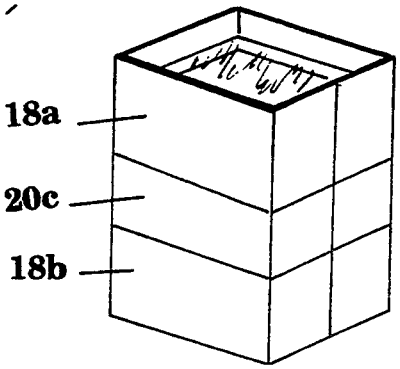

Other embodiments might include a single collar cut through lengthwise to provide top and bottom support to a pair of frames as shown in FIG. 1C, for use within a smaller outer container. FIG. 1D shows two frame assemblies **18*a* and 18*b* separated for use in a taller container (not shown). FIG. 1E shows an additional collar 20*c* providing vertical support between frame assemblies 18*a* and 18*b*** as might be required.

Common packaging tape or the like might be used to attach the collar ends after they have bent around the frame or frames.

FIG. 4 shows another novel feature wherein two rigid frames are sealed within a common membrane 56. The seal between frames at points a and b forms a hinge as in FIG. 4A and, having been sealed using an interrupted edge to cause a perforation, may be separated into independent enclosed frames 22.

The use of two frames as in FIG. 4 is shown in FIG. B wherein a collar having slots or means of forming grooves in the short direction is used to contain or hold multiple pairs of frames.

Another use is shown in FIG. C where one pair of frames 22*a* and 22*b* are held in position for placement in a narrow side opening container 66. This configuration allows the frames to be slid in or out of the container without removing the slotted collar 20. Another pair of frames might be placed in other slots created in the same frame and additional collars could be used in a wider container.

Figure 6A:
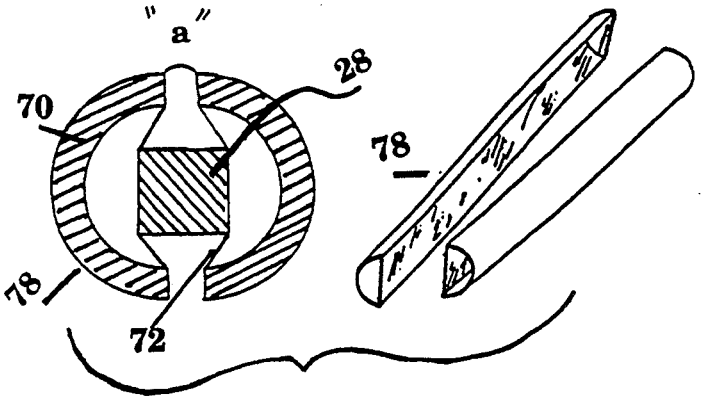
Figure 6B:
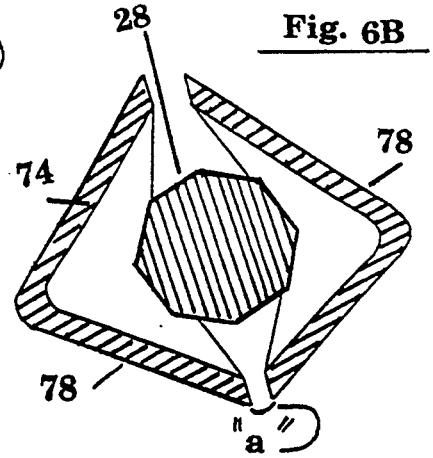
Figure 6C:
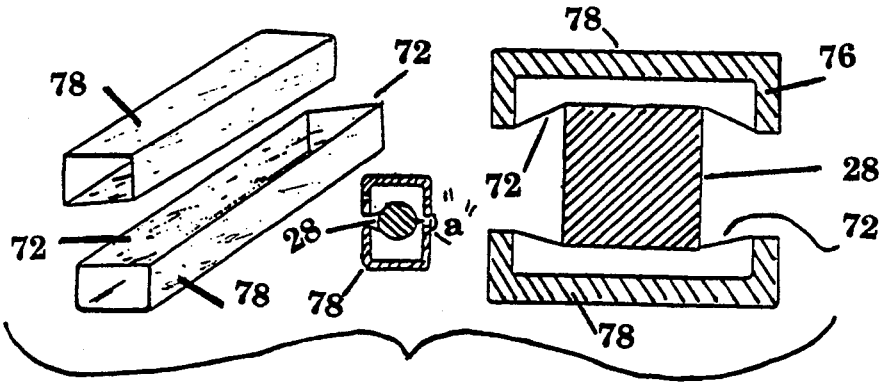

An obvious extension of may use of a flexible membrane to cover or enclose the plane or flat dimensions of the mentioned rigid frames would be the substantial covering of other shapes of rigid materials 70, 74, and 76 as shown in FIGS. 6A, 6B, and 6C.

A sleeve or tube 72, manufactured of material similar to that described in the preferred embodiment of the enclosed frame and of predetermined width or diameter would be supplied to the user and be used to cover common edge protection boards or the like as in FIGS. 6A, 6B, and 6C. This tube or sleeve 72 could be supplied with a center seam at point "a" which would act as a hinge between two forms.

Figure 7A:
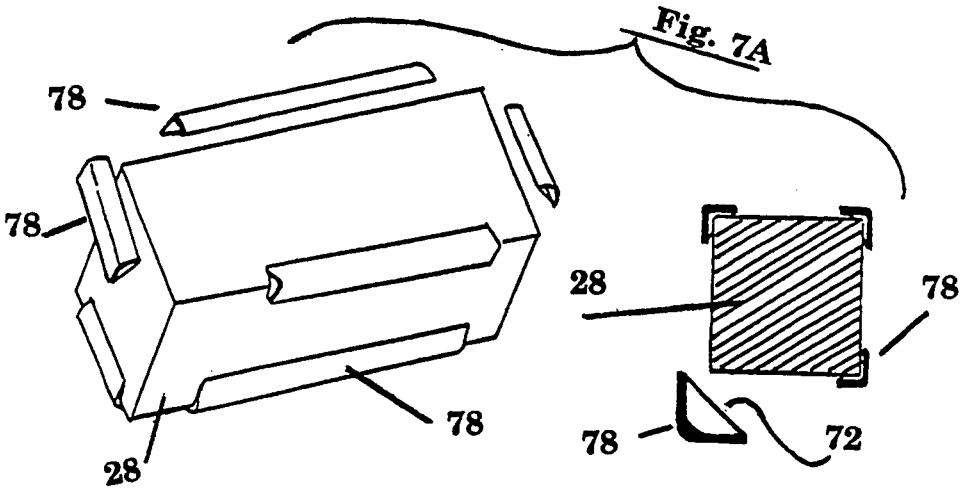

This would provide a flexible surface between the long edges of the forms and provide a shock absorbing means not otherwise provided by the original configured edge protector. This additional surface would provide a non-abrasive surface protection not otherwise provided while "floating" the protected item 28 within the confines of the outer shipping container (not shown) as in FIG. 7A, or between opposing forms as shown in FIGS. 6A, 6B, and 6C.

In another example, FIG. 6A, a common chipboard shipping tube might be slit lengthwise, and each half enclosed within an open ended tube or sleeve of membrane material. This would provide a pair of long, rigid, half moon shaped objects with a flexible membrane across the exposed longitudinal edges. This new configuration could then be used to protect large items within a container (not shown) as in FIG. 7A or used face-to-face to enclose a thin object as in FIGS. 6A, 6B and 6C. "L", "V" or "U" shaped forms could also be used for this purpose.

Another use would be in combination with other devices and as a support or splint type form to spread pressure along a body member as in a sling or cast application. In this case, the membrane covering might be of stretchable cotton or similar porous material.

It will be apparent from the foregoing that while particular forms of the invention have been illustrated and described, modifications can be made and other embodiments can be devised without departing from the spirit and scope of the invention. Accordingly, it is not intended that the invention be limited except as by the appended claims.

What I claim:

1. An apparatus for packing a solid or semisolid object, in combination with an outer container, comprising:

a first frame assembly comprising a first rigid frame having a central aperture which is substantially enclosed within a pliable membrane, and a first collar of flat, semirigid material which has been slotted in such a manner as to hold said first frame in a position other than centered when said first collar is formed around the first frame and being of sufficient dimension to provide stand off from one side of said outer container;

a second frame assembly comprising a second rigid frame of similar dimension as the first frame, said second rigid frame having a central aperture which is substantially enclosed within a pliable membrane, a second collar of similar dimension as said first collar thus providing a means for varying the spacing between opposing first and second frames by choice of orientation of the opposing assemblies and thus a supporting means to a variety of objects positioned between said frames when two frame assemblies are placed in opposition within an outer container.

2. The device of claim 1 where more than two enclosed frames are used with at least two collars within the same container.

3. The device of claim 1 where said first and second rigid frames are enclosed within a common membrane and separated by a seam which acts as a hinge between said first and second frames allowing the joined frames to be separated thus becoming independent enclosed frames.

4. The device of claim 1 where more than two enclosed frames are used with a single collar.

5. The device of claim 1 whereby more than one frame pair are used within a single collar with multiple slots.

6. The device of claim 1 wherein said first and second collars are used to support said enclosed frames.

7. The device of claim 1 wherein a third collar is used to separate said enclosed frames.

* * * * *